US010018443B2

(12) United States Patent
Dziekan

(10) Patent No.: US 10,018,443 B2
(45) Date of Patent: Jul. 10, 2018

(54) BOW FOR A CROSSBOW

(71) Applicant: Marcin Dziekan, Michalowice (PL)

(72) Inventor: Marcin Dziekan, Michalowice (PL)

(73) Assignee: Marcin Dziekan, Michalowice (PL)

( * ) Notice: Subject to any disclaimer, the term of this patent is extended or adjusted under 35 U.S.C. 154(b) by 0 days.

(21) Appl. No.: 15/514,292

(22) PCT Filed: Sep. 22, 2015

(86) PCT No.: PCT/PL2015/050039
§ 371 (c)(1),
(2) Date: Mar. 24, 2017

(87) PCT Pub. No.: WO2016/048180
PCT Pub. Date: Mar. 31, 2016

(65) Prior Publication Data

US 2017/0268846 A1 Sep. 21, 2017

(30) Foreign Application Priority Data

Sep. 25, 2014 (PL) ..... 409602

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
See application file for complete search history.

(56) References Cited

U.S. PATENT DOCUMENTS 3,987,777 A 10/1976 Darlington
6,267,108 B1 7/2001 McPherson et al.
(Continued)

FOREIGN PATENT DOCUMENTS

EP 1495278 B1 7/2007
WO 03/087696 A1 10/2003
WO 2007/060231 A1 5/2007

OTHER PUBLICATIONS

International Search Report and Written Opinion issued PCT/PL2015/050039 dated Dec. 17, 2015 (8 pages).
(Continued)

*Primary Examiner* — John Ricci
(74) *Attorney, Agent, or Firm* — Rothwell, Figg, Ernst & Manbeck, P.C.

(57) ABSTRACT

The invention relates to a bow or prod of a crossbow, said prod having a spring limbs connected with a crosspiece and a working rotatable elements guiding a bowstring and/or cable, and the bowstring and/or the cable, wherein the working rotatable elements guiding the bowstring and/or the cable are located at both ends of the spring limbs, respectively. In one embodiment of the prod, the rear ends of the spring limbs (2) are fastened to both rear ends of the crosspiece (1) by the holders (9) fastened rotatably on the pivots (7*a*), and the working rotatable elements (3) guiding the bowstring (6) are rotatably fastened to the rear ends of the crosspiece (1) and coaxially with said holders (9), said bowstring (6) is fastened at the fastening point (5) with its for receiving the rear working to the first front end of the crosspiece (1), and similarly with its second end to the second opposite front end of the crosspiece (1). The bowstring (6) runs from its for receiving the rear working through first front working rotatable element (8) guiding the bowstring (6), located on the same side of the prod, and connected coaxially by the pivot (7*b*) with the holder (9) of the for receiving the rear working of the first spring limb (2), towards the first rear working rotatable element (3) guiding the bowstring (6), located on the same side of the prod, and next towards the second rear working rotatable element (3) guiding the bowstring (6), located on the opposite side of the prod, and further towards the second front working rotatable element (8) guiding the bowstring (6) and connected coaxi-
(Continued)

Figure 1A:
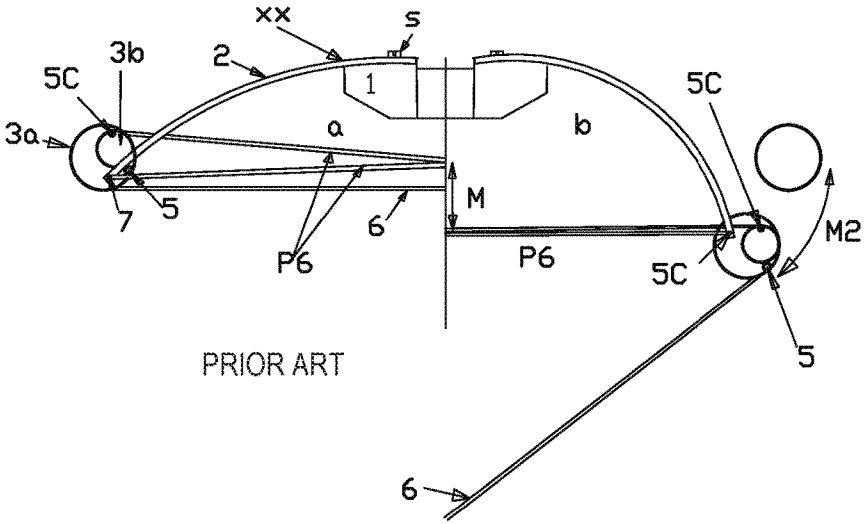
Fig. 1A PRIOR ART

ally with the holder (9) of the front end of the second spring limb (2), and further passing over said second front working rotatable element (8) guiding the bowstring (6), it ends its course at the second front end of the crosspiece (1) with its second end fastened at the fastening point (5). The bowstring (6) runs passes over all the working rotatable elements (3, 8) guiding the bowstring (6).

40 Claims, 8 Drawing Sheets

(56) References Cited

U.S. PATENT DOCUMENTS

| | | | | |
|---|---|---|---|---|
| 7,578,289 | B2 * | 8/2009 | Norkus | F41B 5/0094 124/25 |
| 7,823,572 | B2 * | 11/2010 | Anderson | F41B 5/123 124/25 |
| 7,891,348 | B2 * | 2/2011 | Colley | F41B 5/105 124/25 |
| 8,136,514 | B2 * | 3/2012 | Howard | F41B 5/0094 124/1 |
| 8,578,918 | B1 * | 11/2013 | Islas | F41B 5/123 124/25 |
| 2012/0006311 | A1 | 1/2012 | Bednar et al. | |
| 2014/0069400 | A1 | 3/2014 | Nebergall | |

OTHER PUBLICATIONS

Search Report for Polish Patent Application No. 409602 dated Nov. 26, 2014, 1 page.

* cited by examiner 5
6
7a
7b
7c
8
9
10
1
2
2b
3
4
6a
U
Y
H
G
W

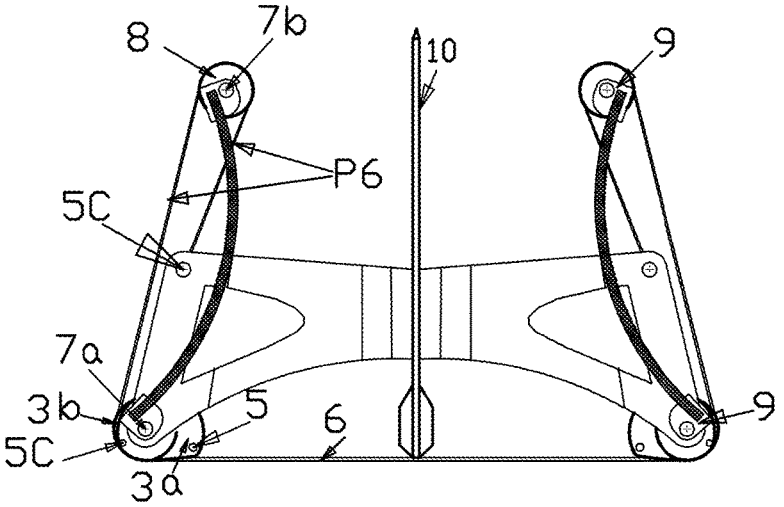
Fig.4A
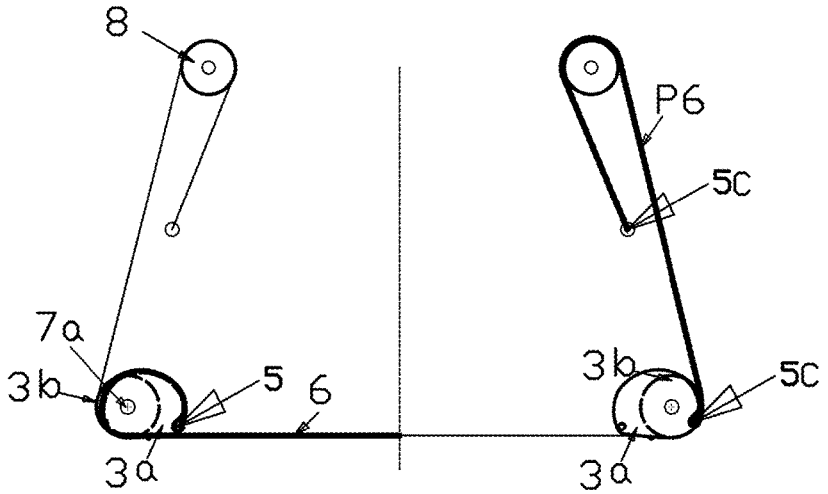
Fig.4B
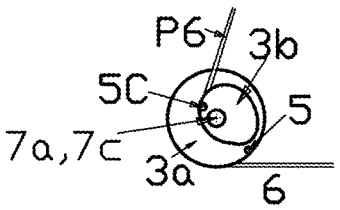
fig 4.1
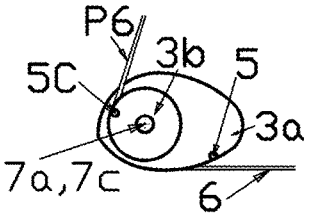
fig 4.2
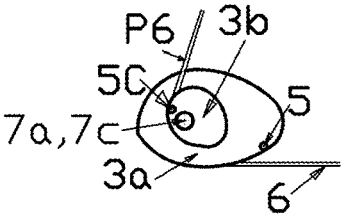
fig 4.3 a
b
D
r
6
XX
5
6a
6a
r a
b
D
r
r
r
8
XX
6
4
3
3
L1
L1<L2
6a
6a
L2

F
9
m
m
9
3
r
8
D
r
6a
P a
b
m
m
F
F

R1
a
b
F
F
F
F

R2
a
b
F
F
F
F
Fig.10T1
Fig.10T2
Fig.10T3
X
Y
KG
0
cm
C
J

BOW FOR A CROSSBOW

CROSS-REFERENCE TO RELATED APPLICATIONS

The present application is a national stage filing under 35 U.S.C. § 371 of PCT/PL2015/050039, filed on 22 Sep. 2015, and claims the benefit of priority to Polish Application No. P409602, filed on 25 Sep. 2014. Each application is incorporated herein by reference in its entirety.

The invention relates to a bow for a crossbow. The bow or prod constitutes the propellant of a crossbow and replaces a conventional or compound bow.

From WO 2003/087696 (EP 1495278 B1, PL 377049) there is known a prod (a bow) of a crossbow with pulleys for the bowstring, said prod having two limbs of which the first limb has at its respective ends a front pulley and a back pulley, and the second limb has at its respective ends a front pulley and a back pulley. Said limbs are pivotally connected by a pins with central crosspiece (riser) connected with pre-cocking mechanism to which a bowstring is fastened. The first end of the bowstring is secured to the pre-drawing mechanism on the side facing the second limb, from where the bowstring runs to the front pulley of the first limb, then along the diagonal of the bow to the back pulley of the second limb, and to the back pulley of the first limb, from which it runs along the diagonal of the bow to the front pulley of the second limb, and then to the spot where its second end is fastened, said spot being located on the pre-cocking mechanism on its side facing the first limb. Said bow limbs are provided at their both ends with recesses in which the pulleys are fixed and through which the bowstring runs. The recesses can be of triangular shape with vertices directed towards the middle of the limbs. In a known embodiment of the crossbow, the pre-cocking mechanism is positioned centrally between the limbs, and has a body with a longitudinal slotted guide for a draw pin, said guide passing through said body in the direction of the limbs. The ends of the bowstring are fastened on both sides of the body to the ends of the draw pin from where the bowstring runs to the front pulleys of the limbs, through a notch on the top of the body adjacent to a threaded hole for a draw screw connected with the draw pin. Moreover, the slotted guide and the threaded hole for the draw screw are located diagonally in relation to the longitudinal axis of the body.

Figure 1B:
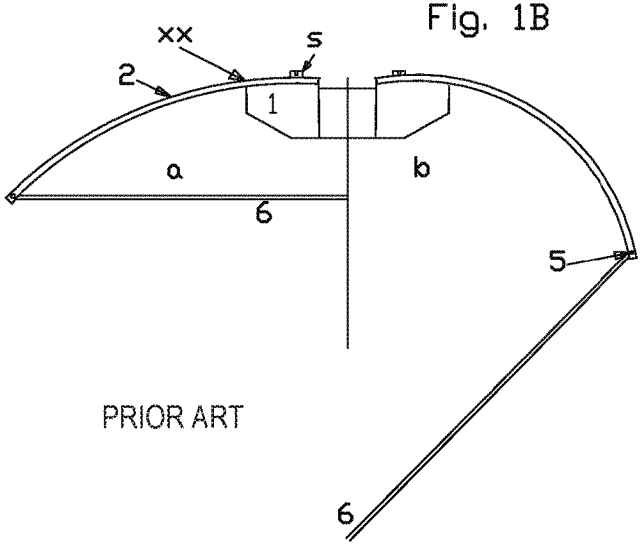
Fig. 1B PRIOR ART

Another known solution is a crossbow as described e.g. in US 2011/0308508, U.S. Pat. No. 6,267,108 B1, U.S. Pat. No. 7,188,615 B2, said crossbow having two eccentric rollers through which a bowstring and a cable run. Said rollers are located on spring limbs that are bent when in use. In this solution the ends of the bowstring are drawn from the bowstring rollers fastened to the cable rollers, which in turn are mounted on pivots at the ends of the limbs which constitute a flexible system, moving with them during use. The limbs are fastened to the crosspiece by the bolts (FIG. 1A) at points S of the highest stress. Said limbs require additional fastening, and thus drilling of the fastening holes which affect the structure, decreasing the strength and bending range, especially as the highest stress concentration takes place in part of the limb supported on the prod. Instead of eccentric rollers, cams are also used in the prior art as rotatable working elements. Known pulley prods have separately the bowstring 6 and the cables P6 for synchronization, and the cams have two working planes with a groove for the bowstring and the cable—enabling the synchronization. A pulley prod is shown in FIG. 1A. This solution uses the eccentric rollers of bi-level type, wherein one level is constituted by the working part of roller/cam 3*a* for the bowstring 6 permanently joined to the working part of roller/cam 3*b* of the cable P6. Said both parts have recesses for guiding the bowstring 6 and the cable P6. The bowstring 6 wraps around the working part of the roller/cam 3*a* of the bowstring 6 and at its end it is fastened to the fastening point 5 of the bowstring 6 on the surface of the working part of the roller/cam 3*a* of the bowstring 6; the bowstring 6 connects/links the right and the left cam/roller 3*a*. The cables P6 are independent elements appearing in pair, and since it is necessary to synchronize the functioning of the cam system, said cables are fastened to the fastening point 5C on the working part of the roller/cam 3*b* of the cable P6 and run to the opposite spring limb; in most cases, they are fastened to the pivot 7 with the fastening 5C of the cable, said cables being defined as Y-cables (bifurcated cables). In a known solution, when the bowstring 6 is drawn, it acts on the roller/cam 3*a* through the working part of the roller/cam 3*a* of the bowstring 6 to which it is fastened with the fastening 5, forcing it to rotate about the pivot 7, resulting in rotation of the working part of the roller/cam 3*b* of the cable P6, which through the fastening 5C of the cable P6 winds up the cable decreasing its length, and the cable P6 acts on the opposite spring limb causing it to bend, and this provides a synchronized rotation of both cams 3*a* and 3*b* about the pivot 7. Said solutions require two rollers/cams joined together and their synchronization. A crossbow prod in a conventional arrangement is shown in FIG. 1B. In FIGS. 1A and 1B the following items are shown: a—rest state, b—cocked state, 1—cross piece of the prod, 2—spring limbs, 3*a*—rollers/cams of the bowstring, 3*b*—rollers/cams of the cable, 5—fastening point of the bowstring 6, 5C—fastening point of the cable, 7—pulley pivots, xx—maximum stress point of the spring limb, M—displacement range of the cables P6, M2—displacement range of the cam in a conventional solution, S—bolt fastening the spring limbs, P6—cables.

Figures 10A, 10B, 10C:
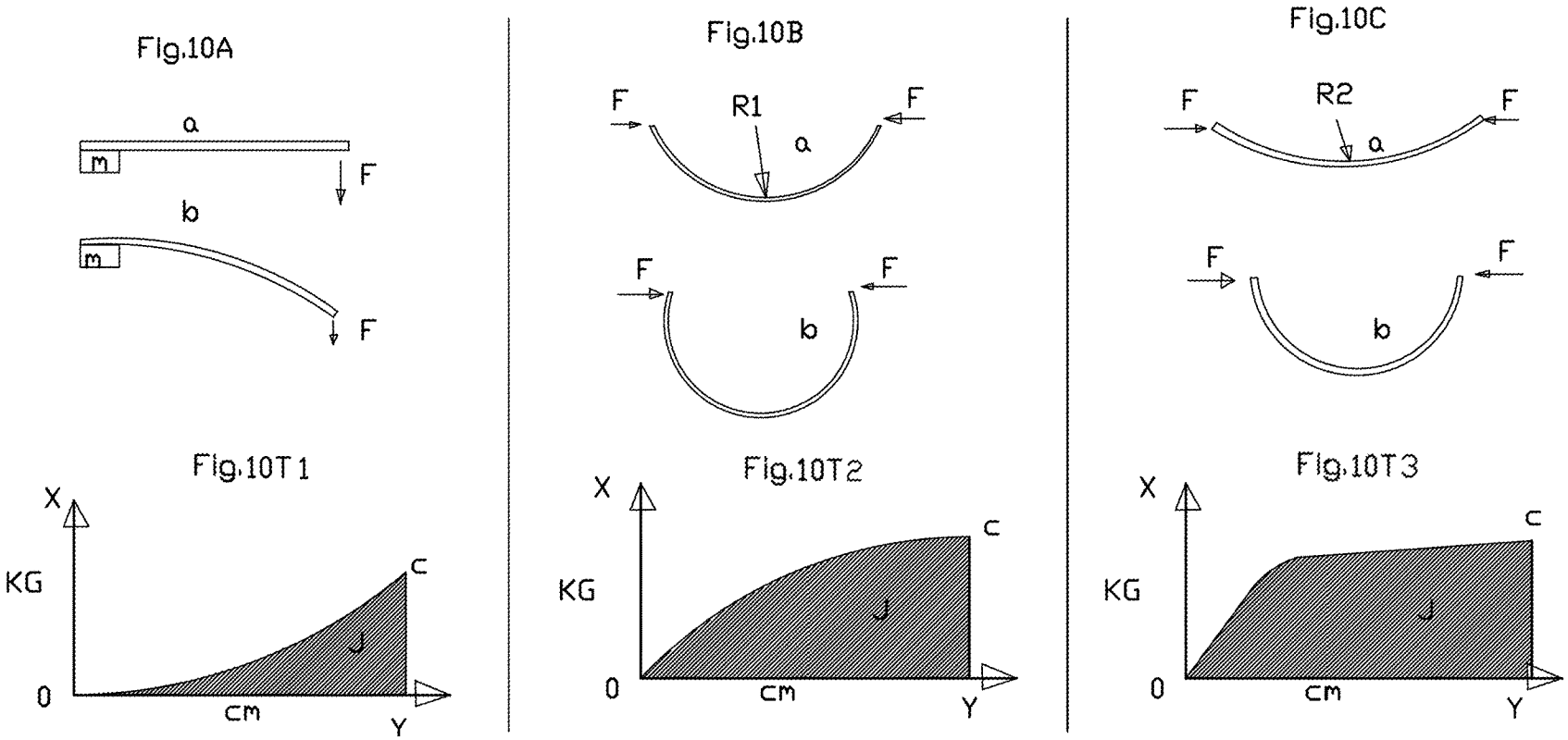

Working characteristics of the prior art spring limbs are shown as the graph in FIG. 10T1, whereas FIG. 10*a* shows a limb spring of the prior art, bent with the force F and fastened to the base m, wherein: a—denotes the initial state, b—the state after bending, x—the axis of force (in kG) required for distortion, y—the axis of deflection degree expressed in cm, J—the energy in Joules, c—the graph of resultant characteristics.

To the best knowledge of the applicant, there is no relevant prior art as far as the inventive bow is concerned.

The prod of a crossbow, having the spring limbs connected with a crosspiece (a riser), and a working rotatable elements guiding a bowstring and/or a cable, and a bowstring and/or the cable, in which the working rotatable elements guiding the bowstring and/or the cable are located at both ends of the spring limbs, according to the invention, is characterized in that the rear ends of the spring limbs are fastened to both rear ends of the crosspiece by the holders fastened rotatably on pivots, and the rear working rotatable elements guiding the bowstring are rotatably fastened to the rear ends of the crosspiece and coaxially with said holders. The bowstring is fastened in the fastening point with its first end to the first front end of the crosspiece, and similarly with its second end to the second, opposite front end of the crosspiece. The bowstring runs from its first end through the first front working rotatable element guiding the bowstring, located on the same side of the prod, said element being coaxially connected by the pivot with the holder of the front end of the first spring limb, towards the first rear working rotatable element guiding the bowstring, located on the same side of the prod, and next towards the second rear working rotatable element guiding the bowstring, located on the opposite side of the prod, and further towards the second front working rotatable element guiding the bowstring and connected coaxially with the holder of the front end of the second spring limb, then passing over said second front working rotatable element guiding the bowstring ending its course in the second front end of the crosspiece, fastened with its second end in the fastening point. The bowstring passes over all working rotatable elements guiding the bowstring.

Preferably, the prod comprises two single spring limbs.

Preferably, the prod comprises two double spring limbs.

Preferably, the prod comprises two identical pairs of the spring limbs on both sides of the prod, said spring limbs have in pairs different curvatures.

Preferably, the prod comprises two identical pairs of the spring limbs on both sides of the prod, said spring limbs have in pairs identical curvatures.

The crosspiece has a form of an elongated profile of the rectangular contour, said profile being a frame section with an axially profiled channel for receiving a bolt, said crosspiece is preferably in a form of one piece element.

The crosspiece has recesses for the working rotatable elements guiding the bowstring.

Preferably, the bowstring dampers are fastened to the prod.

The rear working rotatable elements are cams or rollers or pulleys.

The front working rotatable elements are in form rollers or pulleys.

Preferably, the ends of the bowstring are fastened by a loop or bifurcated at the fastening point.

According to alternative embodiment, the prod of a crossbow, having the spring limbs connected with a crosspiece (a riser) and a working rotatable elements guiding a bowstring and/or a cable, and a bowstring and/or a cable, in which the working rotatable elements guiding the bowstring and/or the cable are located at both ends of the spring limbs, respectively, is characterized in that the rear ends of the spring limbs are fastened to both rear ends of the crosspiece by the holders fastened rotatably on pivots, and the rear working rotatable elements guiding the bowstring are rotatably fastened to the rear ends of the crosspiece and coaxially with said holders. The intermediate working rotatable elements guiding the bowstring are rotatably fastened on pivots to both front ends of the crosspiece, said bowstring is fastened in the fastening point with its first end to the pivot of the first front working rotatable element guiding the bowstring. Similarly, said bowstring is fastened with its other end in the fastening point to the pivot of the second front working rotatable element guiding the bowstring. The bowstring runs from its first end through the first intermediate working rotatable element guiding the bowstring, located on the same side of the prod, then through the first front working rotatable element guiding the bowstring and connected coaxially by the pivot with the holder of the front end of the first spring limb, towards the first rear working rotatable element guiding the bowstring, located on the same side of the prod, and next towards the second rear working rotatable element guiding the bowstring, located on the opposite side of the prod, and further towards the second front working rotatable element guiding the bowstring and connected coaxially with the holder of the front end of the second spring limb, and further turns back passing over the second intermediate working rotatable element guiding the bowstring, located at the second front end of the crosspiece, ending its course in the opposite fastening point located on the same side of the prod. The bowstring passes over all the working rotatable elements guiding the bowstring.

Preferably, the prod comprises two single spring limbs.

Preferably, the prod comprises two double spring limbs.

Preferably, the prod comprises two identical pairs of spring limbs on both sides of the prod, said spring limbs have in pairs different curvatures.

Preferably, the prod comprises two identical pairs of spring limbs on both sides of the prod, the spring limbs have in pairs identical curvatures.

The crosspiece has a form of an elongated profile of the rectangular contour, said profile being a frame section with an axially profiled channel for receiving a bolt, said crosspiece is preferably in a form of one piece element.

The crosspiece has recesses for receiving the rear working rotatable elements guiding the bowstring.

The crosspiece has recesses for receiving the intermediate working rotatable elements guiding the bowstring.

Preferably, the bowstring dampers are fastened to the crosspiece of the prod.

The rear working rotatable elements guiding the bowstring and/or the intermediate working rotatable elements guiding the bowstring are cams and/or rollers and/or pulleys.

The front working rotatable elements are cams or rollers or pulleys.

The ends of the bowstring are fastened by a loop or bifurcated at the fastening point.

According to further alternative embodiment, the prod of a crossbow, having the spring limbs connected with a crosspiece (a riser) and a working rotatable elements guiding the bowstring and/or a cable, and a bowstring and/or the cable, in which the working rotatable elements guiding the bowstring and/or the cable are located at both ends of the spring limbs, respectively, is characterized in that the rear ends of the spring limbs are fastened by the holders fastened rotatably on pivots to both rear ends of the crosspiece, and the rear working rotatable elements cams/rollers guiding the bowstring are rotatably fastened to the rear ends of the crosspiece and coaxially with said holders, and the rear working cams/rollers of the cable are rotatably connected by the pivot and coaxially with said holders. The bowstring is fastened in the fastening point with its first ends to both opposite cams/rollers of the bowstring on both lower sides of both ends of the crosspiece. Each cable is fastened in the fastening point with its lower end to the first and second rear cam/roller of the cable, respectively, located oppositely, further running vertically upwards to the second front rotatable working element guiding the cable, coaxially connected with the holder of the front end of the second spring limb, and wrapping it around it goes to the fastening point of the cable, ending its course at the second end of the crosspiece.

Preferably, the prod comprises two single spring limbs.

Preferably, the prod comprises two double spring limbs.

Preferably, the prod comprises two identical pairs of spring limbs on both sides of the prod, said spring limbs have in pairs different curvatures.

Preferably, the prod comprises two identical pairs of spring limbs on both sides of the prod, said spring limbs have in pairs identical curvatures.

The crosspiece has a form of an elongated profile of the rectangular contour, said profile being a frame section with an axially profiled channel for receiving a bolt, said crosspiece is preferably in a form of one piece element.

The crosspiece has recesses for receiving the rear working rotatable elements guiding the bowstring.

Preferably, the bowstring dampers are fastened to the crosspiece of the prod.

The front working rotatable elements are rollers or pulleys.

Preferably, the ends of the bowstring and/or the cable are fastened by a loop or bifurcated at the fastening point of the bowstring/cable.

The terms "front" and "rear" as used herein concern the locations of respective elements, close or distal, respectively, when using the crossbow.

The inventive prod of a crossbow has a constant, unchanging width, and the rotatable working elements guiding the bowstring and/or the cable are connected with the crosspiece of the prod, rotating about their axes only, and thus the spring limb puts in motion the bowstring by the rotatable working elements guiding the bowstring and/or the cable, fastened rotatably in the crosspiece of the prod, which do not move together with the spring limbs while working, which takes place in the prior art.

Each side of the prod, left and right, constitutes an independent elastic working element, without any mutual synchronization, said elements being connected in symmetrical arrangement by the working section of the bowstring only (similarly as in conventional bows—without cams), due to this solution in which the ends of each spring limb working in said arrangement are compressed—there is no high concentration of tangential stress within the crosspiece, but only in the central section of a freely suspended spring limb. This allows for using a much lighter prod, thus reducing the cross-sections, rotating masses and stress points.

The structure of the prod of the invention allows to assemble a compact crossbow having a small width, easy to cock with a little effort, but giving a high draw force with advantageous flat characteristics. The crossbow with the prod of the invention allows for firing projectiles with a high initial velocity.

Figures 2A, 2B, 2C, 2D, 2E, 3:
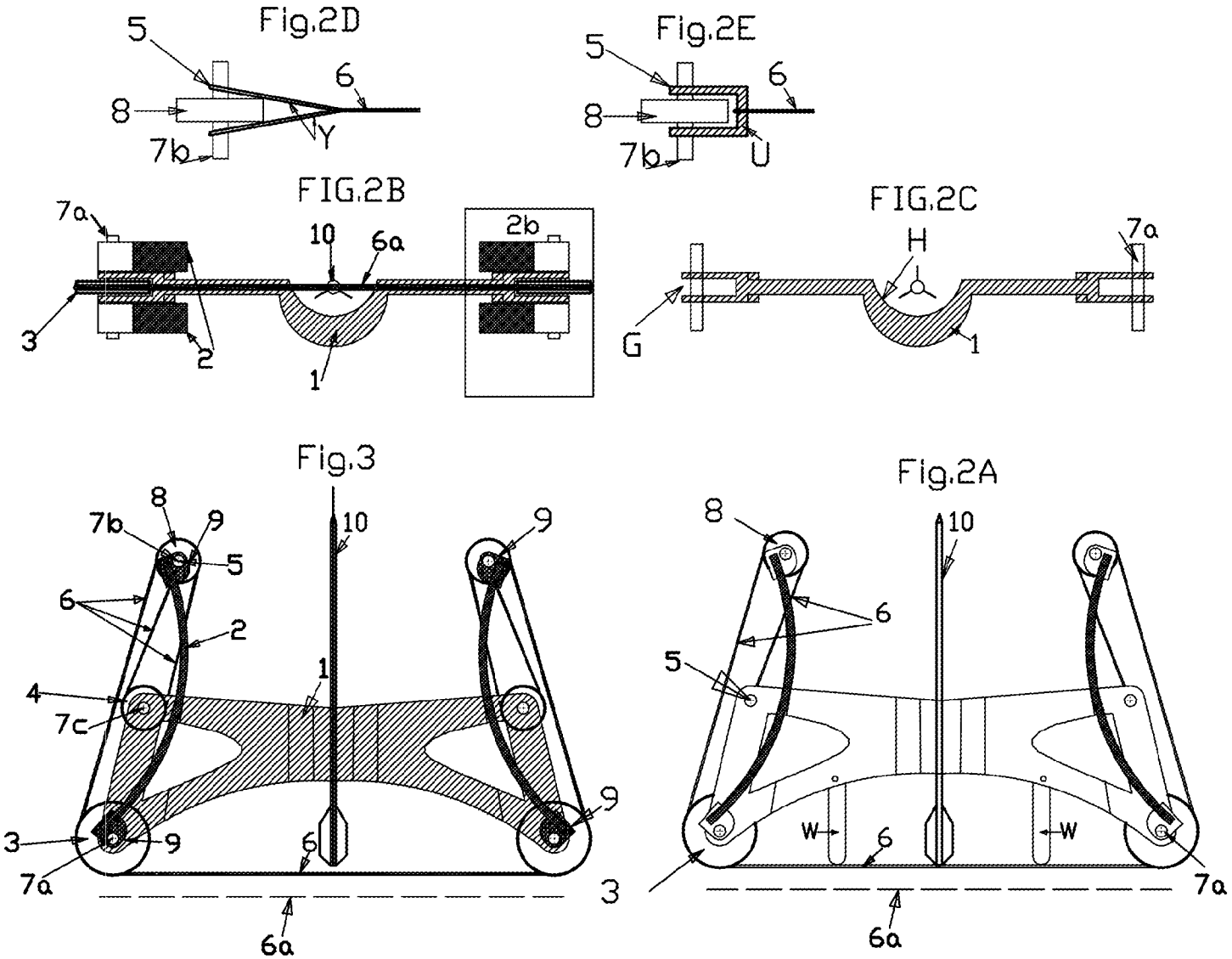
Figure 5B:
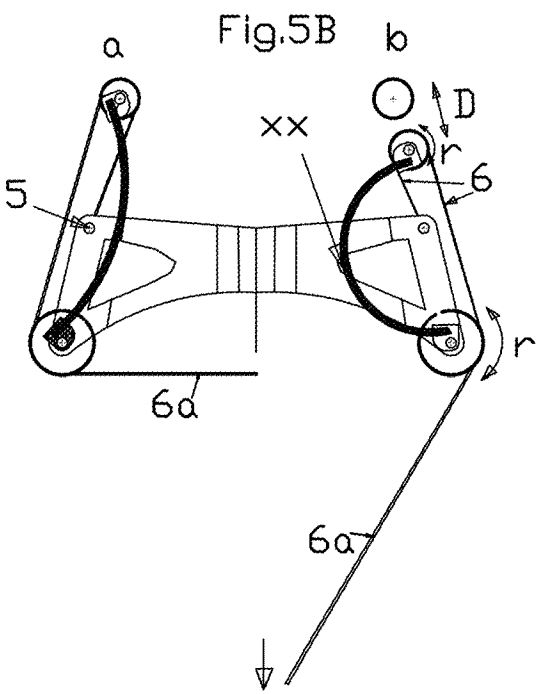
Figure 5A:
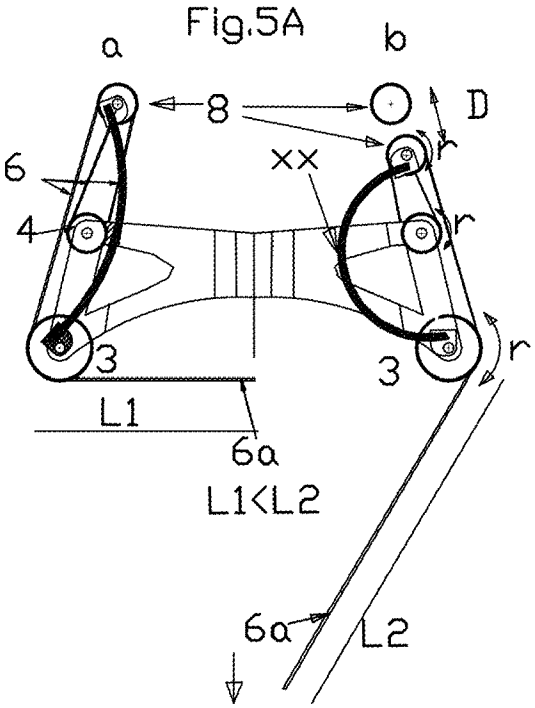
Figure 7:
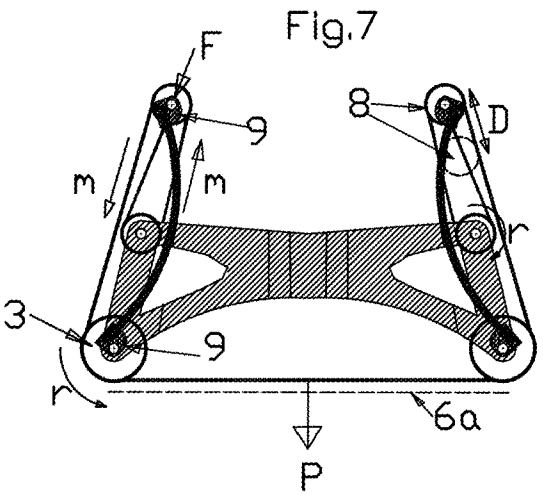
Figure 6B:
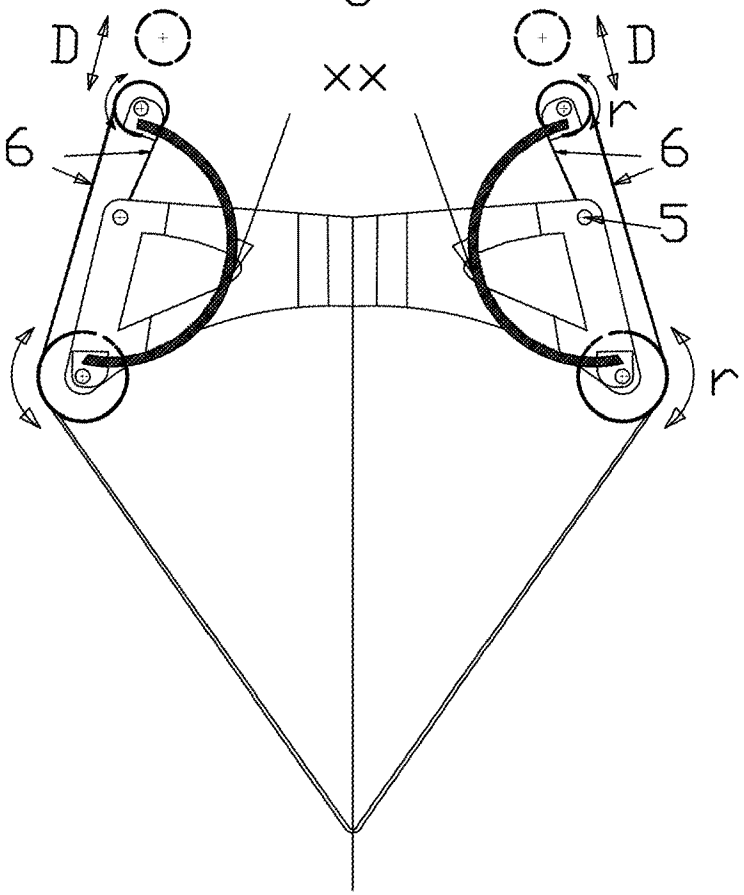
Figure 6A:
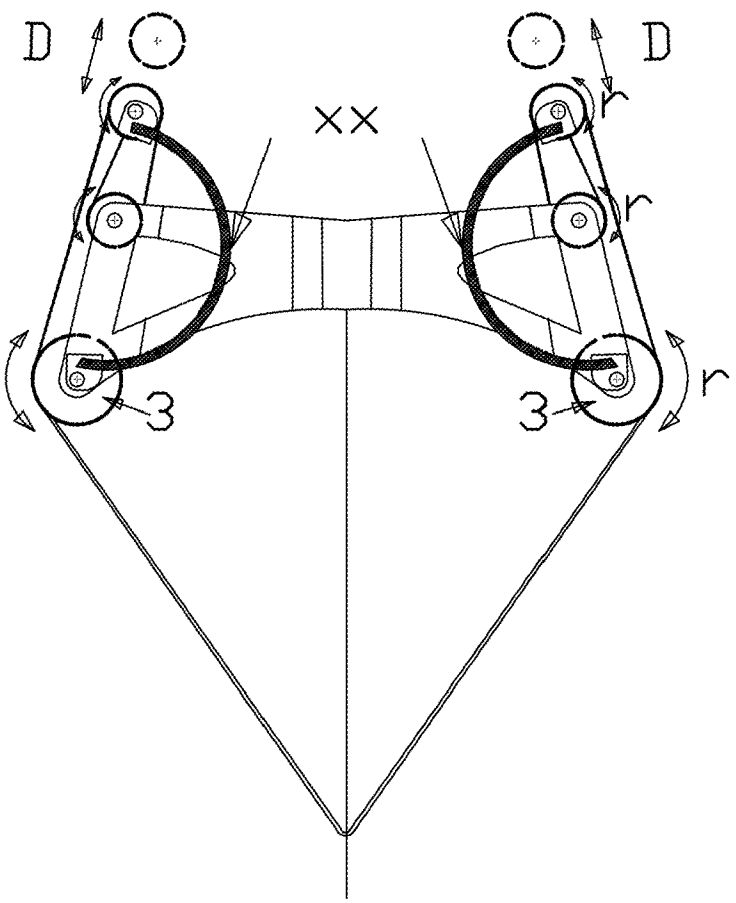
Figure 8A:
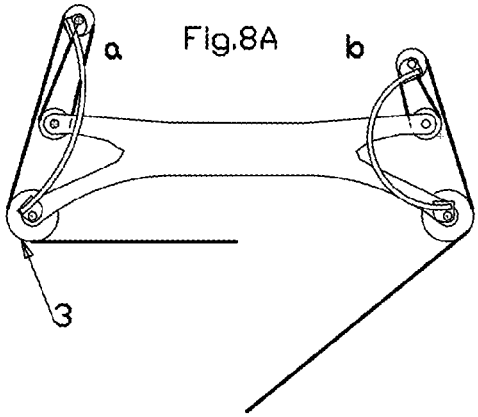
Figure 8D:
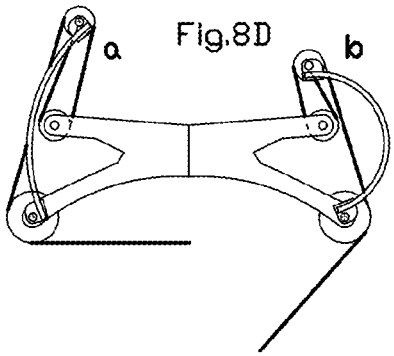
Figure 8E:
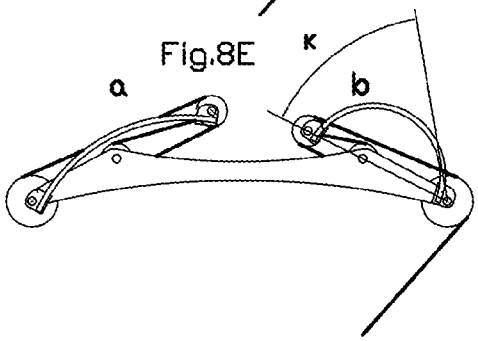
Figure 8B:
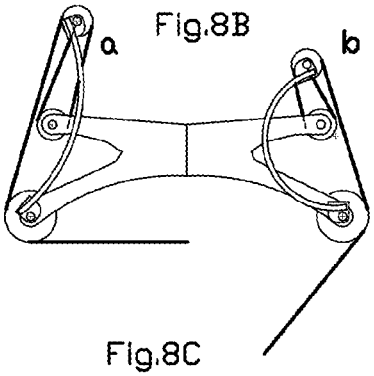
Figure 9:
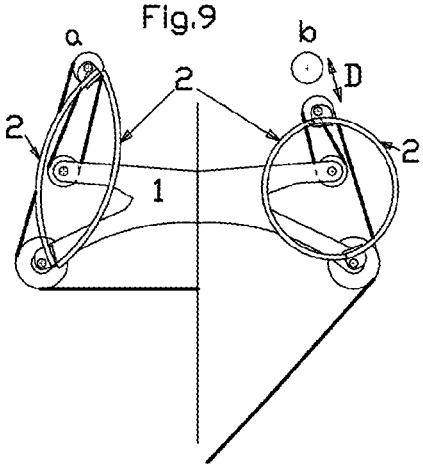
Figure 8C:
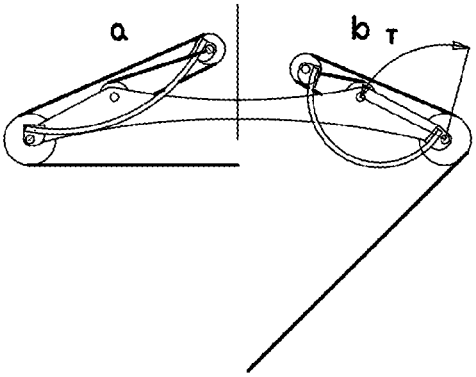
Figure 9B:
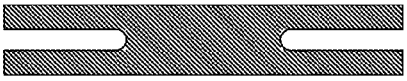
Figure 9A:
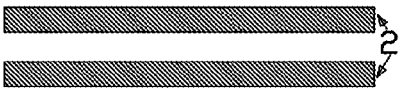
Figure 9C:
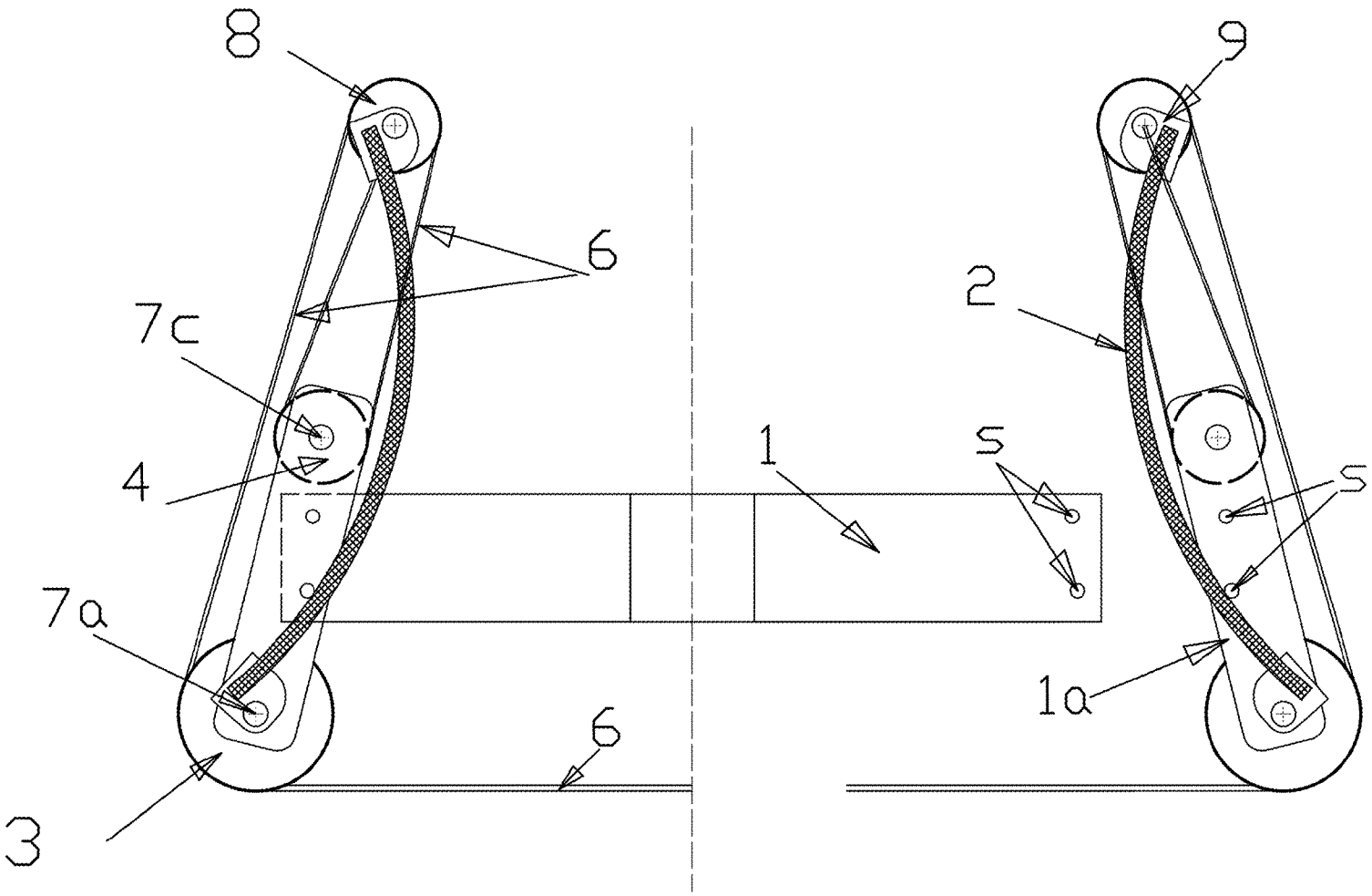

Additional objects and advantages of the invention will become apparent to those skilled in the art upon reference to the detailed description of the invention in connection with the accompanying drawing, wherein:

FIG. 1A shows a prod of a crossbow according to the prior art in a pulley configuration, FIG. 1B shows a prod of a crossbow according to the prior art in a conventional configuration, FIG. 2A shows a prod arrangement of the invention with four rollers, in which the bowstring is fastened to the first and second end of the crosspiece, and the bowstring dampers W are fastened to the yoke by the bolts S, FIG. 2B is a rear view of the prod of the crossbow of the invention (from the bowstring side) with one working module 2*b* shown (see the frame), FIG. 2C is a cross-section of the yoke of the prod showing the recesses for the back and intermediate working elements guiding the bowstring, and an axially profiled channel for a projectile, FIG. 2D shows the fastening of the bowstring/cable end as a Y-type end, FIG. 2E shows a similar view of a loop-type end, FIG. 3 is a top view of the prod of the crossbow of the invention in an uncocked state, a version with six rollers according to the invention, FIG. 4A shows a version of the solution, in which a bi-level cams are used as working rotatable elements, wherein the bowstring cam is located above the cable cam, and both working pieces (for the cables and the bowstring) are integrated with each other, and mounted as a bi-level cam on a common axis, FIG. 4B shows one possible arrangement with the cams according to FIG. 4A, presenting the arrangement of the cables and the bowstring, FIG. 4.1, 4.2, 4.3 show different arrangements of a roller and a cam, a cam and a roller and two cams arranged as in FIGS. 4A and 4B, FIG. 5A shows the degree of distortion of the spring limbs while use, in an exemplary arrangement with six rollers—as in the solution according to FIG. 3, FIG. 5B shows the point of maximum stress in the spring limbs of the invention, in an exemplary arrangement with four rollers—as in the solution according to FIG. 2A, FIG. 6A shows an exemplary arrangement of FIG. 5A with four rollers FIG. 6B shows an exemplary arrangement of FIG. 5B with four rollers—in a cocked state of the bowstring, FIG. 7 shows the direction of motion m of the bowstring and the sense of rotation r of the rollers, when the force P acts on the middle of the working section 6*a* of the bowstring, FIG. 8A shows a broad prod—spring limbs curved towards the inside, FIG. 8B shows a narrow prod—spring limbs curved towards the inside, FIG. 8C shows a short prod—spring limbs curved towards the inside, FIG. 8D shows a narrow prod—spring limbs curved towards the outside, FIG. 8E shows a short prod—spring limbs curved towards the outside, FIG. 9 shows another example of an arrangement with the spring limbs curved towards the inside as well as to the outside, with the spring limbs having identical curvature FIG. 9A is a view of a double spring limb, FIG. 9B is a view of a single spring limb, FIG. 9C shows a version of the prod with a crosspiece made of permanently connected arms, FIG. 10A shows a spring limb of the prior art bent with the force F, FIG. 10T1 shows the working characteristics of the bent spring limbs of the prior art, FIGS. 10B and 10C show the effect of a spring limb radius variation, and of its curvature, FIG. 10B shows a compressed spring limb with a short radius R1 and its characteristics in FIG. 10T2, FIG. 10C shows a spring limb with a long radius R2 and its characteristics in FIG. 10T3.

The same or equivalent elements carry the same reference numbers throughout all the figures.

The motion work the prod of a crossbow has the immobile rear working rotatable elements 3, preferably working pulleys or rollers and/or cams fastened to the crosspiece 1 (another term riser) being the auxiliary frame of the prod joining both ends of the working section of the bowstring 6 supported on said pulleys or rollers and/or cams, and joining it with the whole flexible arrangement (with the spring limb 2, the pivot 7*b* of rotatable elements, the auxiliary rotatable elements 8 of the spring limbs 2, the holder 9 of the spring limbs 2), in which the spring limb 2 is compressed with a force F, and not bent as in the prior art (FIGS. 1A and 1B, as well as 10A and 10B, 10C). The bowstring 6 is in contact with the arrow (bolt 10). The rear working rotatable element may be pulleys, rollers, cams, multilevel cams or other elements having shaped characteristics (not shown, known to those skilled in the art in general). The spring limb 2 is provided with the front working rotatable elements 8 fastened to the tips of the spring limb 2 by the holders 9 of the spring limbs 2. At the opposite rear end of the spring limb 2 there are the holders 9 through which the pivots 7a pass, being the axes of the rear working rotatable elements, passing through the holes drilled across the arms of the crosspiece 1.

The crosspiece 1 has a form of an elongated profile of the rectangular contour, said profile being a frame section with a axially profiled channel H for the projectile or the bolt 10. Said crosspiece is in a form of one piece element but it may consist of several pieces connected permanently together, as in FIG. 9C. The crosspiece 1 may be provided with two or four working rotatable elements 3, 4 mounted on the pivots 7a and 7c, respectively. In case when the crosspiece 1 has four working rotatable elements, the two from the working side of the bowstring 6 are the working rotatable elements 3, and two other are the auxiliary working rotatable elements 4 (FIG. 3). The working rotatable elements 3 are located and fastened on the pivots 7a in respective horizontal recesses H of the crosspiece and prod.

It is also possible to use the crosspiece 1 of the prod with the working rotatable elements 3 and the auxiliary working rotatable elements 4, or one pair of working rotatable elements 3 depending on a tension length of the bowstring 6 and flexibility of the spring limbs 2 (FIG. 5A, 5B).

FIG. 2A shows a bow arrangement in which the bowstring dampers W are fastened to the crosspiece 1 of the prod by the screws S, said dampers have to dampen the vibrations and noise resulting from the work of the bowstring. This solution can be used in all the exemplary embodiments of the bowstring.

The basis of the solution according to the invention is that in case of change of direction of the loads acting on the spring limbs—in this case compressed with the force F (FIGS. 7, 10B and 10C), and not bent as in the prior arrangement (FIGS. 1A and 1B, and 10A), it is possible to shape their working characteristics, and that enables to obtain an advantageous characteristics without using multi-level cams and their synchronization (however, it is also a possible solution, but not shown in the drawings), only selecting the shape of the spring limbs and direction of their load (compression F), (FIGS. 7, 10B and 10C, graphs in FIGS. 10T2c and 10T3). In FIGS. 10T1, 10T2 and 10T3, the X-axis denotes the force in kg, and the Y-axis—the flection in cm and the energy J. In the graph in FIGS. 10T2 and 10T3, in case of the spring limbs circular sector, it is possible to shape the characteristics through appropriate selection of the initial curvature (radius) R1 R2 of the spring limbs—see FIGS. 10B and 10C, where: R1<R2. A spring limb with the radius R1 different characteristics under the force F than a spring limb with the radius R2; differences are shown in FIGS. 10B and 10C. FIG. 10B shows a situation in which the spring limb is compressed along its longitudinal axis, which leads to the increase of the curvature of said spring limb. FIG. 10T2 is a graph showing the bending characteristics of a compressed spring limb, where a characteristic becomes convex due to the manner in which the spring limb is loaded. In case the spring limbs 2 circular sector are used, it is possible to shape the characteristic through appropriate selection of the initial curvature (radius) of the spring limbs 2.

As far as bending geometry of the spring limbs 2 and its characteristics are concerned, said solution is much more efficient than conventional prods (FIGS. 10T1 and 10T2, and 10T3).

In the solution of the invention, the bowstring 6 is drawn from an arrangement of the spring limbs 2 by two working rotatable elements 3 fastened only in rotary manner at the rear ends of the crosspiece 1 of the prod, and the remaining rollers 4 and 8 or only 8 are responsible for compressing the spring limbs 2 (FIGS. 5A and 5B, 6A and 6B), said displacement D concerning only rollers 8 of the spring limbs (FIGS. 5A and 5B).

In case of the solution with one pair of working rotatable elements 3 on the crosspiece 1, the ends of the bowstring 6—loops are fastened to the fastening points 5.

When the bowstring 6 is cocked in the middle of the working section 6a of the bowstring 6, said section is subject to elongation at the expense of the rest of the bowstring 6 cooperating with the arrangement of six rotatable elements (3, 4, 8) or four rotatable elements (3, 8), the bowstring 6 begins to compress F all the spring limbs 2 along their longitudinal axis, leading to their bending (FIG. 5A, 5B). The working section 6a is located between the rollers being the working rotatable elements 3.

It is also very important that in contrast with known solutions in which the spring limbs are fastened to the crosspiece by the screws S (FIGS. 1A and 1B) in the points of maximum stress xx, in the present solution the spring limbs 2 do not need any additional fastening except those in the holders 9 at the ends of the spring limbs 2—thus, there is no need to drill the fixing holes, affecting the structure and decreasing the strength, and thus the bending range, especially as the highest stress concentration xx takes place in the central part of the spring limb, i.e. optimally in relation to its load points (FIGS. 5A and 5B).

It has to be noted that in contrast to known solutions of pulley prods, wherein the separate working bowstring and the auxiliary cables for synchronization are used, this material system has a single bowstring, and its length is responsible for the initial cocking characteristics, as in a conventional bow, regardless of the cooperation with six or four rollers (FIGS. 5A and 5B).

Fastening of the working rotatable elements 3 to the rigid and the immobile element of the prod crosspiece 1 considerably increases the stiffness of the whole system (FIG. 8A-8E).

Fastening of the working rotatable elements 3 cams, or pulleys, or rollers guiding the bowstring 6, to the rigid element also ensures very reliable and accurate guiding of the bowstring 6, and the working rotatable elements 3 as well as the auxiliary rotatable elements 4 perform during work only a rotary motion about the axis, on which they are mounted, and their inertia does not load the spring limbs 2 (FIGS. 2A and 3).

The single cams may be used as rotatable elements (not shown, generally known to those skilled in the art), such as used in a double construction (FIGS. 4.1-4.3).

Since the working rotatable elements 3 are fastened to the rigid crosspiece 1 of the prod, there is possible, in contrast with the prior art (FIGS. 1A and 1B), not only a very precise guiding of the bowstring 2 in the plane of the prod but also a free positioning of the spring limbs in relation to the axes 7a of the working rotatable elements 3, as well symmetrically as unsymmetrically, thus giving the prod any geometric shape and enabling to compensate the inertia of the spring limbs during the shot and to reduce its influence on the shooter (FIG. 5A). Said positioning is obtained by modifying the position of the auxiliary rotatable elements 4 or fastening 5 of the bowstring 6 through the rotation of the working rotatable elements 3 or the axis 7a of the cams 3a in relation to the axis 7a.

Since the working rotatable elements 3 are separated from the working elements, it is possible to shape the width of the bow freely as well as its geometric arrangement, as shown in FIG. 8A-8E.

When using the spring limbs 2 semi-elliptic or flat springs, there are the holders 9 for the pivots 7*a* and 7*b* of the working rotatable elements 3 and the auxiliary rotatable elements 8 of the spring limbs 2 at the ends of the spring limbs 2 (FIG. 2A).

In the structure of the invention, the width of the prod is independent from the weight of the bowstring 6. The weight of the bowstring 6 is to be understood as the maximum value in kilograms (or pounds) obtained when cocking the bowstring 6 to a given draw length (this is the maximum distance between the working section of the bowstring 6 in a cocked state and its position in a rest state, expressed in inches or centimeters). Such a separation of elastic elements—spring limbs—the from working rotatable elements 3 of the bowstring 6 through their rotatable mounting in the crosspiece 1 of the prod enables the use of any span of the prod regardless of the length of the spring limbs 2, and thus the obtainment of any draw length of the bowstring 6 (FIGS. 6A and 6B) with a very limited span—since the length of the draw depends only on the flexibility of the spring limbs 2, and not on system geometry.

As compared to the prior art, the auxiliary rotatable elements 8 of the spring limbs 2 are in the holders 9 on the pivots 7*b* at the free front ends of the spring limbs 2 but due to their small dimensions and small displacements during work of the spring limbs 2, their weight constitutes a mall load of the spring limbs 2, thus said elements do not reduce their efficiency due to the inertia. In contrast with the prior art in which the working rotatable elements—cams—have two working planes (with a bowstring groove—the one as a working and the other for cables—synchronization)—the working rotatable elements are located in one working planes.

It is possible to use double or single spring limbs located on each side of the prod, as well as packs of the 2×4 spring limbs on each side of the prod with two symmetry planes. The crosspiece 1 makes a rigid frame to which rear arms the rear working rotatable elements 3 are rotatably. The shape of the crosspiece 1 depends on a material used: in general said crosspiece has a rectangular or trapezoid shape with an increasing taper, as it can be seen in FIGS. 8A-8E. FIGS. 8A, 8B, 8C, 8D, 8E show different possible arrangements of the spring limbs 2 fastened in the crosspiece 1, and thus a variation of shape of the whole prod. The rotation T of the axis of the auxiliary rollers 4 or the fastening 5 of the bowstring 6 on the pivot 7*a* in the crosspiece 1 causes the system of the spring limbs to rotate by an identical angle K, thus affecting the shape of the whole prod. FIG. 8A shows a wide prod in which the spring limbs 2 have their curvature directed towards the inside. FIG. 8B shows a narrow prod in which the spring limbs 2 have their curvature directed towards the outside. FIG. 8C shows a short prod in which the spring limbs have their curvature directed towards the inside. FIG. 8D shows a narrow prod in which the spring limbs have their curvature directed towards the outside. FIG. 8E shows a short prod in which the spring limbs 2 have their curvature directed towards the outside. FIG. 9 shows another embodiment with a pack arrangement comprising the spring limbs 2 with curvatures directed to the outside or to the inside, with the spring limbs having identical curvatures. The springs limbs may be duplicated or made of different curvatures, in order to obtain better characteristics (not shown in the drawing).

Flexible elements—spring limbs 2—may appear in a composite version or any other (it is possible to use different flexible elements, even pneumatic ones).

It is possible to use any combination of the spring limbs and of their shape in order to obtain advantageous working characteristics of the bowstring 6.

In one exemplary embodiment of the invention (FIG. 2A) the prod of the crossbow has the spring limbs 2 connected with the crosspiece 1 and the working rotatable elements 3 guiding the bowstring 6 and the bowstring 6, where the working rotatable elements 3 guiding the bowstring 6 are located at both ends of the spring limbs 2, respectively. The Rear ends of the spring limbs 2 are fastened to both ends of the crosspiece 1 by the holders 9 fastened rotatably on the pivots 7*a*. The rear working rotatable elements 3 guiding the bowstring 6 are rotatably fastened and coaxially with said holders 9 to said rear ends of the crosspiece 1. The bowstring itself 6 is fastened at the fastening point 5 with its first end to the first front end of the crosspiece 1, and similarly, with its second end, to the second opposite end of the crosspiece 1. The bowstring 6 runs from its first end through the first front working rotatable element 8 guiding the bowstring 6 located on the same side of the prod connected coaxially by the pivot 7*b* with the holder 9 of the front end of the first spring limb 2, towards the first rear working rotatable element 3 guiding the bowstring 6, located on the same side of the prod. Then it runs towards the second rear working rotatable element 3 guiding the bowstring 6 located on the opposite side of the prod, and further towards the second front working rotatable element 8 guiding the bowstring 6 and connected coaxially with the holder 9 of the front end of the second spring limb 2, and then, passing through said second front working rotatable element 8 guiding the bowstring 6, ends its course at the second front end of the crosspiece 1, with its second end fastened to the fastening point 5. The bowstring 6 passes over all the working rotatable elements 3, 8 guiding the bowstring 6.

The prod may have two single spring limbs 2 or two double spring limbs 2. The prod may have two identical pairs of spring limbs 2 on both sides of the prod, said spring limbs 2 have in pairs different curvatures. As an alternative, the prod may have two identical pairs of spring limbs 2 on both sides of the prod, said spring limbs 2 have in pairs identical curvature.

The crosspiece 1 has a form of an elongated profile of the rectangular contour, said profile being a frame section with an axially profiled channel H for the projectile or the bolt 10 said crosspiece 1 is in a form of one piece element. Furthermore, the crosspiece 1 has recesses G for receiving the rear working rotatable elements 3 guiding the bowstring 6. The Dampers W of the bowstring 6 may be fastened to the crosspiece 1 of the prod. Furthermore, the rear working rotatable elements 3 guiding the bowstring 6 may be cams or rollers or pulleys, whereas the front working rotatable elements 8 guiding the bowstring 6 may be rollers or pulleys. The ends of the bowstring 6 are fastened by a loop or bifurcated in the fastening point 5, which, however, does not exclude other fastening equivalent methods, known to those skilled in the art.

In another exemplary embodiment of the invention (FIG. 3), the prod of the crossbow has the spring limbs 2 connected with the crosspiece 1 and the working rotatable elements 3 guiding the bowstring 6 and the bowstring 6, where the working rotatable elements 3 guiding the bowstring 6 are located at both ends of the spring limbs 2, respectively. The rear ends of the spring limbs 2 are fastened to both rear ends of the crosspiece 1 by the holders 9 fastened rotatably on the pivots 7*a*. The rear working rotatable elements 3 guiding the bowstring 6 are fastened rotatably to the rear ends of the crosspiece 1 and coaxially with said holders 9. The intermediate working rotatable elements 4 guiding the bowstring 6 are fastened rotatably to both front ends of the crosspiece 1 on the pivots 7*c*—while the bowstring 6 is fastened at the fastening point 5 with its first end to the pivot 7*b* of the first front working rotatable element 8 guiding the bowstring 6, and in a similar manner, with its second end at the fastening point 5 to the pivot 7*b* of the second front working rotatable element 8 guiding the bowstring 6. The bowstring 6 runs from its first end through the first intermediate working rotatable element 4 guiding the bowstring 6 located on the same side of the prod, then through the first front working rotatable element 8 guiding the bowstring 6, coaxially connected through the pivot 7*b* with the holder 9 of the front end of the first spring limb 2, towards the first rear working rotatable element 3 guiding the bowstring 6, located on the same side of the prod, and next towards the second rear working rotatable element 3 guiding the bowstring 6, located on the same side of the prod, and further towards the second front working rotatable element 8 guiding the bowstring 6, coaxially connected with the holder 9 of the front end of the spring limb 2, and further turns back, passing through the second intermediate working rotatable element 4 guiding the bowstring 6, located at the second frond end of the crosspiece 1, and ends its course at the opposite fastening point 5 located on the same side of the prod. The bowstring 6 passes over all the working rotatable elements 3, 4, 8 guiding the bowstring 6.

The prod may have two single spring limbs 2 or two double spring limbs 2.

The prod may have two identical pairs of spring limbs 2 on both sides of the prod, said spring limbs 2 have in pairs different curvatures. As an alternative, the prod may have two identical pairs of spring limbs 2 on both sides of the prod, said spring limbs 2 in pairs have identical curvatures.

The crosspiece 1 has a form of an elongated profile of the rectangular contour, said profile being a frame section with an axially profiled channel H for the projectile or the bolt 10 said crosspiece 1 is in a form of one piece element. Furthermore, the crosspiece 1 has recesses G for receiving the rear working rotatable elements 3 guiding the bowstring 6. The Dampers W of the bowstring 6 may be fastened to the crosspiece 1 of the prod. Furthermore, the crosspiece 1 has recesses G' for receiving the intermediate working rotatable elements 4 guiding the bowstring 6. The rear working rotatable elements 3 guiding the bowstring 6 and/or the intermediate working rotatable elements 4 guiding the bowstring 6 are cams, but rollers or pulleys could also be used, whereas the front working rotatable elements 8 guiding the bowstring 6 may be rollers or pulleys. The ends of the bowstring 6 are fastened by a loop or bifurcated at the pivot 7*b*, which, however, does not exclude other fastening equivalent methods, known to those skilled in the art.

In yet another exemplary embodiment of the invention (FIGS. 4A and 4B), the prod of the crossbow has the spring limbs 2 connected with the crosspiece 1 and the bowstring 6 and two cables P6. The bi-level cams/rollers are used as the working rotatable elements guiding the bowstring 6 and the cable P6. Said working rotatable elements guiding the bowstring 6 and/or the cable P6 are located at both rear ends of the spring limbs 2. The rear ends of the spring limbs 2 are fastened to both rear ends of the crosspiece 1, by the holders 9 fastened rotatably on the pivots 7*a*. the rear working rotatable elements are fastened coaxially with said holders 9 to the rear ends of the crosspiece 1, said element being cams/rollers 3*a* guiding the bowstring 6, with which the rear working cams/rollers 3*b* of cable P6 are rotatably connected, coaxially through the pivot 7*a*. The bowstring 6 is fastened at the fastening point 5 with its first ends to both opposite cams/rollers 3*a* of the bowstring 6 on both lower sides of both ends of the crosspiece 1. Each cable P6 is fastened at the fastening point 5C with its lower end to the first and second rear cam/roller 3*b* of the cable P6, respectively, located opposite to each other, and then runs vertically upwards, towards the second front working rotatable element 8 guiding the cable P6 and connected coaxially with the holder 9 of the front end of the second spring limb 2, and wrapping it around it goes to the fastening point 5C of the cable P6, ending its course at the second end of the prod 1.

As in the previous exemplary embodiments, the prod may have two single spring limbs 2 or two double spring limbs 2. The prod may have two single spring limbs 2 or two double spring limbs 2. The prod may have two identical pairs of spring limbs 2 on both sides of the prod, said spring limbs 2 have in pairs different curvatures. As an alternative, the prod may have two identical pairs of spring limbs 2 on both sides of the prod, said spring limbs 2 in pairs have identical curvatures.

The crosspiece 1 has a form of an elongated profile of the rectangular contour, said profile being a frame section with an axially profiled channel H for the projectile or the bolt 10 said crosspiece 1 is in a form of one piece element. The crosspiece 1 has recesses G for receiving the rear working rotatable elements 3 guiding the bowstring 6, the dampers W of the bowstring 6 may be fastened to the crosspiece 1. The front working rotatable elements 8 guiding the bowstring 6 may be rollers or pulleys. The ends of the bowstring 6 and/or of cable P6 are fastened by a loop or bifurcated in the fastening point 5 of the bowstring 6/fastening point 5C of the cable P6, which, however, does not exclude other fastening equivalent methods, known to those skilled in the art.

The cam 3*a* of the bowstring 6 is located above the plane of the cam 3*b* of the cable P6 (or vice versa), and both of them are joined together and placed as a bi-level cam on the pivot 7*a*. FIGS. 4A and 4B show one of the possible arrangements with bi-level cams instead of the rotatable elements mentioned above, showing the configuration of the bowstring on the working part of the cam 3*a* of the bowstring 6, and its fastening at the fastening point 5, as well as the configuration of the cable P6 on the working part of the cam 3*b* of the cable P6, and the fastening of the cable P6 at the fastening points 5C. In FIG. 4B, the bowstring 6 and the cable P6 are marked in bold, see left and right part of the figure respectively. During the cocking, the bowstring 6 located in the recess of the working part of the cam 3*a* of the bowstring 6, fastened at the fastening point 5, begins to unwind causing the whole cam 3*a* to rotate on the pivot 7*a*, thus causing the cables fastened at the fastening point 5C to wind on the recess on the working part of the cam 3*b* of the cable, which due to a suitable shape of both working surfaces of the cam 3A enables an appropriate shaping of the system characteristics. The ends of the bowstring 6/cable P6 are fastened in a manner known to those skilled in the art, e.g. by a loop, or bifurcated at the fastening point 5 of the bowstring 6/fastening point 5C of the cable P6. It is also possible to use bi-level systems of the cams or the cams and rollers as described above, which was shown in FIGS. 4.1, 4.2 and 4.3.

The whole prod structure comprises:

1 crosspiece of the prod 2 spring limbs/spring limbs

2*a* one working module

3 working rotatable elements
3*a* bowstring cam
3*b* cable cam
4 auxiliary rotatable elements
5 fastening point of the bowstring
5C fastening point of the cable
6 bowstring
6*a* working section of the bowstring
P6 cable
7*a* pivots of the working rotatable elements
7*b* pivots of the working rotatable elements of spring limbs
7*c* pivots of the auxiliary rotatable elements
8 auxiliary rotatable elements
9 spring limb holders
10 bolt
a rest state
b state after cocking
G recesses for the working elements of the crosspiece
H channel for bolt
Xx maximum stress point of the spring limb
D displacement range of the auxiliary elements of the spring limb
r rotary motion of the rotatable elements
L1 length of the working section 6*a* of the bowstring in a rest state
L2 length of the working section 6*a* of the bowstring in a cocked state
M displacement range of the synchronization bowstrings P6
M2 displacement range of the roller in a conventional solution
S fastening bolt for the spring limbs
W bowstring dampener
P direction of the force acting on the working section of the bowstring
R1 short radius
R2 long radius
x axis of the force required for distortion, in kG
y axis of the bending level expressed in cm
J energy in joules
c graph of the resultant characteristics

The invention claimed is:

1. A prod of a crossbow comprising:
a crosspiece (1) having first and second front ends and first and second rear ends,
first and second spring limbs (2) connected with the crosspiece (1), wherein rear ends of the spring limbs (2) are fastened to the first and second rear ends of the crosspiece (1) by holders (9) fastened rotatably on pivots (7*a*, 7*b*),
a bowstring (6) and/or a cable, and
working rotatable elements, including first and second front working rotatable elements (8) and first and second rear working rotatable elements (3), guiding the bowstring and/or the cable, wherein the working rotatable elements guiding the bowstring and/or the cable are located at both ends of the spring limbs, respectively, and wherein the rear working rotatable elements (3) guiding the bowstring (6) are rotatably fastened to the rear ends of the crosspiece (1) coaxially with said holders (9),
wherein a first end of the bowstring (6) is fastened to the first front end of the crosspiece (1), in a fastening point (5), and a second end of the bowstring (6) is fastened to the second, opposite front end of the crosspiece (1),
wherein the bowstring (6) passes over all working rotatable elements (3, 8) guiding the bowstring (6) and runs
(a) from its first end over the first front working rotatable element (8) guiding the bowstring (6), located on a first side of the prod, said first front working rotatable element being coaxially connected by the pivot (7*b*) with the holder (9) of the front end of the first spring limb (2),
(b) towards the first rear working rotatable element (3) guiding the bowstring (6), located on the first side of the prod,
(c) towards the second rear working rotatable element (3) guiding the bowstring (6), located on an opposite side of the prod,
(d) towards the second front working rotatable element (8) guiding the bowstring (6) and connected coaxially with the holder (9) of the front end of the second spring limb (2), and
(e) over said second front working rotatable element (8) guiding the bowstring (6) and
wherein the bowstring ends its course in the second front end of the crosspiece (1), fastened with its second end in the fastening point (5).

2. The prod according to claim 1, wherein the spring limbs (2) are two single spring limbs.

3. The prod according to claim 1, wherein the spring limbs (2) are two double spring limbs.

4. The prod according to claim 1, wherein each side of the prod has two identical pairs of spring limbs (2) and wherein the spring limbs (2) of each pair have different curvatures.

5. The prod according to claim 1, wherein each side of the prod has two identical pairs of spring limbs (2) and wherein the spring limbs (2) of each pair have identical curvatures.

6. The prod according to claim 1, wherein the crosspiece (1) has a rectangular frame section with an axially profiled channel (H) for receiving an arrow (bolt 10).

7. The prod according to claim 1, wherein the crosspiece (1) one piece.

8. The prod according to claim 1, wherein the crosspiece (1) has recesses (G) for receiving the rear working rotatable elements (3) guiding the bowstring (6).

9. The prod according to claim 1, wherein the the bowstring (6) has dampers (W) fastened to the crosspiece (1) of the prod.

10. The prod according to claim 1, wherein the rear working rotatable elements (3) guiding the bowstring (6) are cams.

11. The prod according to claim 1, wherein the rear working rotatable elements (3) guiding the bowstring (6) are rollers.

12. The prod according to claim 1, wherein the rear working rotatable elements (3) guiding the bowstring (6) are pulleys.

13. The prod according to claim 1, wherein the front working rotatable elements (8) guiding the bowstring (6) are rollers or pulleys.

14. The prod according to claim 1, wherein the ends of the bowstring (6) are fastened by a loop or bifurcated at the fastening point (5).

15. A prod of a crossbow comprising:
a crosspiece (1) having first and second front ends and first and second rear ends,
first and second spring limbs (2) connected with the crosspiece (1), wherein rear ends of the spring limbs (2) are fastened to the first and second rear ends of the crosspiece (1) by holders (9) fastened rotatably on pivots (7*a*, 7*b*), a bowstring (6) and/or a cable, and working rotatable elements, including first and second front working rotatable elements (8), first and second intermediate working rotatable elements (4) and first and second rear working rotatable elements (3), guiding the bowstring and/or cable, wherein the working rotatable elements guiding the bowstring and/or the cable are located at both ends of the spring limbs, respectively, wherein the rear working rotatable elements (3) guiding the bowstring (6) are rotatably fastened to the rear ends of the crosspiece (1) coaxially with said holders (9), and wherein the intermediate working rotatable elements (4) guiding the bowstring (6) are rotatably fastened on pivots (7*c*) to both front ends of the crosspiece (1), wherein a first end of said bowstring (6) is fastened to pivot (7*b*) of the first front working rotatable element (8) in a fastening point (5), and a second end of said bowstring (6) is fastened to pivot (7*b*) of the second front working rotatable element (8) in a fastening point (5), wherein the bowstring (6) passes over all of the working rotatable elements (3, 4, 8) guiding the bowstring (6) and runs (a) from its first end over the first intermediate working rotatable element (4) guiding the bowstring (6), located on a first side of the prod, and then over the first front working rotatable element (8) guiding the bowstring (6) said first front working rotatable element being coaxially connected through the pivot (7*b*) with the holder (9) of the front end of the first spring limb (2), (b) towards the first rear working rotatable element (3) guiding the bowstring (6), located on the first side of the prod, (c) towards the second rear working rotatable element (3) guiding the bowstring (6), located on an opposite side of the prod, (d) towards the second front working rotatable element (8) guiding the bowstring (6) and connected coaxially with the holder (9) of the front end of the second spring limb (2), (e) towards and passing over the second intermediate working rotatable element (4) guiding the bowstring (6), located at the second front end of the crosspiece (1), and wherein the bowstring ends its course in the opposite fastening point (5) located on the same side of the prod as the second front working rotatable element (8).

16. The prod according to claim 15, wherein the spring limbs (2) are two single spring limbs.

17. The prod according to claim 15, wherein the spring limbs (2) are two double spring limbs.

18. The prod according to claim 15, wherein each side of the prod has two identical pairs of spring limbs (2) and wherein the spring limbs (2) of each pair have different curvatures.

19. The prod according to claim 15, wherein each side of the prod has two identical pairs of spring limbs (2) and wherein the spring limbs (2) of each pair have identical curvatures.

20. The prod according to claim 15, wherein the crosspiece (1) has a rectangular frame section with an axially profiled channel (H) for receiving an arrow (bolt 10).

21. The prod according to claim 15, wherein the crosspiece (1) is one piece.

22. The prod according to claim 15, wherein the crosspiece (1) has recesses (G) for receiving the rear working rotatable elements (3) guiding the bowstring (6).

23. The prod according to claim 15, wherein the crosspiece (1) has recesses (G') for receiving the intermediate working rotatable elements (3) guiding the bowstring (6).

24. The prod according to claim 15, wherein the bowstring (6) has dampers (W) fastened to the crosspiece (1) of the prod.

25. The prod according to claim 15, wherein the rear working rotatable elements (3) and/or the intermediate rotatable working elements (4) guiding the bowstring (6) are cams.

26. The prod according to claim 15, wherein the rear working rotatable elements (3) and/or the intermediate rotatable working elements (4) guiding the bowstring (6) are rollers.

27. The prod according to claim 15, wherein the rear working rotatable elements (3) and/or the intermediate rotatable working elements (4) guiding the bowstring (6) are pulleys.

28. The prod according to claim 15, wherein the front working rotatable elements (8) guiding the bowstring (6) are rollers or pulleys.

29. The prod according to claim 15, wherein the ends of the bowstring (6) are fastened by a loop or bifurcated at the axis (7*b*).

30. A prod of a crossbow comprising:

a crosspiece (1) having first and second front ends and first and second rear ends first and second spring limbs (2) connected with the crosspiece, wherein rear ends of the spring limbs (2) are fastened to the first and second rear ends of the crosspiece (1) by holders (9) fastened rotatably on pivots (7*a*), a bowstring (6), two cables (P6), and working rotatable elements, including first and second rear working rotatable elements and first and second front working rotatable elements (8) guiding the bowstring and/or cable, wherein the working rotatable elements guiding the bowstring and/or the cable are located at both ends of the spring limbs, respectively, wherein the rear working rotatable elements guiding the bowstring (6) are cams/rollers (3*a*) rotatably fastened to the rear ends of the crosspiece (1) coaxially with said holders (9), and wherein the rear working rotatable elements guiding each cable (P6) are cams/rollers (3*b*) rotatably connected by pivot (7*a*) coaxially with said holders (9), wherein a first end of the bowstring (6) is fastened to the cam/roller (3*a*) rotatably fastened to the first front end of the crosspiece (1) in fastening point (5) and a second end of the bowstring (6) is fastened to the cams/rollers (3*a*) rotatably fastened to the second, opposite front end of the crosspiece (1), wherein a first end of each cable (P6) is fastened to a rear cam/roller (3*b*) on one rear end of the crosspiece (1) in a fastening point (5C), wherein each cable (P6) runs (a) from its first end fastened to a rear cam/roller (3*b*) on one side of the crosspiece (1), (b) towards a front rotatable working element (8) guiding the cable (P6), located on the same side of the prod, said front working rotatable element being coaxially connected with the holder (9) of the front end of spring limb (2), and (c) over the front working rotatable element guiding cable (P6) and wherein the cable (P6) ends its course in the front end of the crosspiece (1) in a fastening point (5C).

31. The prod according to claim 30, wherein the spring limbs (2) are two single spring limbs.

32. The prod according to claim 30, wherein the spring limbs (2) are two double spring limbs.

33. The prod according to claim 30, wherein each side of the prod has two identical pairs of spring limbs (2) and wherein the spring limbs (2) of each pair have in pairs different curvatures.

34. The prod according to claim 30, wherein each side of the prod has two identical pairs of spring limbs (2) and wherein the spring limbs (2) of each pair have identical curvatures.

35. The prod according to claim 30, wherein the crosspiece (1) has a rectangular frame section with an axially profiled channel (H) for receiving an arrow (bolt 10).

36. The prod according to claim 30, wherein the crosspiece (1) is one piece.

37. The prod according to claim 30, wherein the crosspiece (1) has recesses (G) for receiving the rear working rotatable elements (3) guiding the bowstring (6).

38. The prod according to claim 30, wherein the bowstring (6) has dampers (W) fastened to the crosspiece (1) of the prod.

39. The prod according to claim 30, wherein the front working rotatable elements (8) guiding the bowstring (6) are rollers or pulleys.

40. The prod according to claim 30, wherein the ends of the bowstring (6) and/or the cable (P6) are fastened by a loop or bifurcated at the fastening point (5) of the bowstring (6) or fastening point (5C) of the cable (P6).

* * * * *